US006986302B2

(12) United States Patent
LaFata

(10) Patent No.: US 6,986,302 B2
(45) Date of Patent: Jan. 17, 2006

(54) FRIENDLY FIRE PREVENTION SYSTEMS AND METHODS

(75) Inventor: Christopher M. LaFata, St. Louis, MO (US)

(73) Assignee: The Boeing Company, Chicago, IL (US)

( * ) Notice: Subject to any disclaimer, the term of this patent is extended or adjusted under 35 U.S.C. 154(b) by 141 days.

(21) Appl. No.: 10/698,582

(22) Filed: Oct. 30, 2003

(65) Prior Publication Data

US 2005/0115386 A1 Jun. 2, 2005

(51) Int. Cl.
*F41G 3/04* (2006.01)

(52) U.S. Cl. ..... 89/1.11; 89/41.18; 342/357.09; 342/67

(58) Field of Classification Search ..... 89/1.11, 89/41.03, 41.18; 342/357.09, 67; 235/404
See application file for complete search history.

(56) References Cited

U.S. PATENT DOCUMENTS

| | | | | |
|---|---|---|---|---|
| 5,046,006 | A * | 9/1991 | Revord et al. | 89/1.1 |
| 5,231,400 | A * | 7/1993 | Mouldin et al. | 342/45 |
| 5,822,713 | A * | 10/1998 | Profeta | 701/302 |
| 5,992,288 | A * | 11/1999 | Barnes | 89/1.11 |
| 6,467,388 | B1 * | 10/2002 | Malakatas | 89/41.03 |
| 6,839,662 | B2 * | 1/2005 | Schnatterly et al. | 703/6 |
| 2005/0024634 | A1 * | 2/2005 | Barker et al. | 356/301 |

* cited by examiner

*Primary Examiner*—Stephen M. Johnson
(74) *Attorney, Agent, or Firm*—Black Lowe & Graham, PLLC

(57) ABSTRACT

Systems and methods for preventing accidental friendly fire situations from occurring are provided. Locator devices provide location information of friendly forces to a plurality of command centers. The command centers also receive targeting information from friendly weapon systems and determines if the friendly weapon systems are targeting any of the friendly forces. If a friendly force is determined to be targeted, an associated command center instructs the weapon system to be disabled from firing.

21 Claims, 4 Drawing Sheets

FRIENDLY FIRE PREVENTION SYSTEMS AND METHODS

FIELD OF THE INVENTION

This invention relates generally to combat weapon systems and, more specifically, to systems and methods for safe weapons operations.

BACKGROUND OF THE INVENTION

A common problem encountered by modern armed forces during the confusion of battle, as evidenced during the Gulf War, is the phenomenon known as "friendly fire" in which forces accidentally fire on their own troops causing unnecessary casualties and fatalities. Instances of friendly fire often involve aircraft or helicopters accidentally firing on their own ground troops. In addition, such incidents often occur at night when visibility is poor. Conventional techniques employed to make ground troops and their equipment more easily identifiable, and thus prevent such mishaps from occurring, include placing visual identifying markers such as inverted letters or geometric designs on armored equipment such as tanks, armored personnel carriers, etc., and placing brightly colored tarps on such equipment. In addition, conventional two-way radios are employed to enable troops to communicate with one another and thus prevent such mishaps.

All of the aforementioned techniques suffer from drawbacks. The aforementioned visual markers and colored tarps are only visible during the day. Thus, they will not eliminate friendly fire incidents, which might occur at night. Moreover, such markings and tarps are not readily visible by different concentrations of ground forces, which are separated over relatively large distances. Furthermore, since markings and tarps are only visible by a pilot flying at relatively close distances to any equipment so marked, the possibility exists that a pilot who flies near an unidentified concentration of ground troops to see if they are so marked will be attacked if such troops turn out to be the enemy.

The drawback to using conventional two-way radios to identify troops is that if the unidentified troops are enemy troops and if they are monitoring the frequency over which such transmissions are made, they will be alerted to the presence of a potentially hostile force. In addition, since the initial transmission might have to be sent several times in order to contact the unidentified troops, and since a given period of time will in all likelihood elapse before a response is received, such lapses of time makes it more likely that the unidentified troops might discover the presence of the troops sending the initial transmission and attack such troops while they are waiting for the response.

Therefore, there exists an unmet need for systems and methods that provide safety for friendly armed forces without diminishing the forces effectiveness.

SUMMARY OF THE INVENTION

The present invention provides systems and methods for preventing accidental friendly fire situations from occurring.

According to one exemplary non-limiting embodiment of the present invention, a system includes a plurality of friendly force locator devices each having a communication component and each determines location information of one or more friendly personnel. A plurality of weapon systems determine weapon effect information and determine if the weapon is in an aim mode or fire mode. Each of a plurality of computer-based systems include a first communication component adapted to receive the determined location information, the determined weapon effect information, and the weapon mode information. Each computer-based system includes memory that stores received location information, and a second communication component that communicates with other computer-based systems. A processor of each computer-based system determines if at least one of the friendly personnel is effected by one of the weapon systems based on the received location information, and the weapon effect information and generates a disable signal, if at least one of the friendly personnel is determined to be effected by one of the weapon systems and the weapon is in the fire mode.

According to an aspect of the present invention, the memory further includes an image of a battlefield. The processor determines if one or more friendly personnel would be effected by one of the weapon systems by mapping location information to the image, determines an area of effect on the image based on the weapon effect information, and determines if the location information places one or more friendly personnel within the area of effect on the image.

According to another aspect, if a weapons operator overrides a disabled signal, information indicating this is recorded and an alert is sent to the personnel that is located within the area of effect.

BRIEF DESCRIPTION OF THE DRAWINGS

The preferred and alternative embodiments of the present invention are described in detail below with reference to the following drawings.

DETAILED DESCRIPTION OF THE INVENTION

The present invention relates to combat weapon systems and methods. Many specific details of certain embodiments of the invention are set forth in the following description and in FIGS. 1–4 to provide a thorough understanding of such embodiments. One skilled in the art, however, will understand that the present invention may have additional embodiments, or that the present invention may be practiced without several of the details described in the following description.

Figure 1:
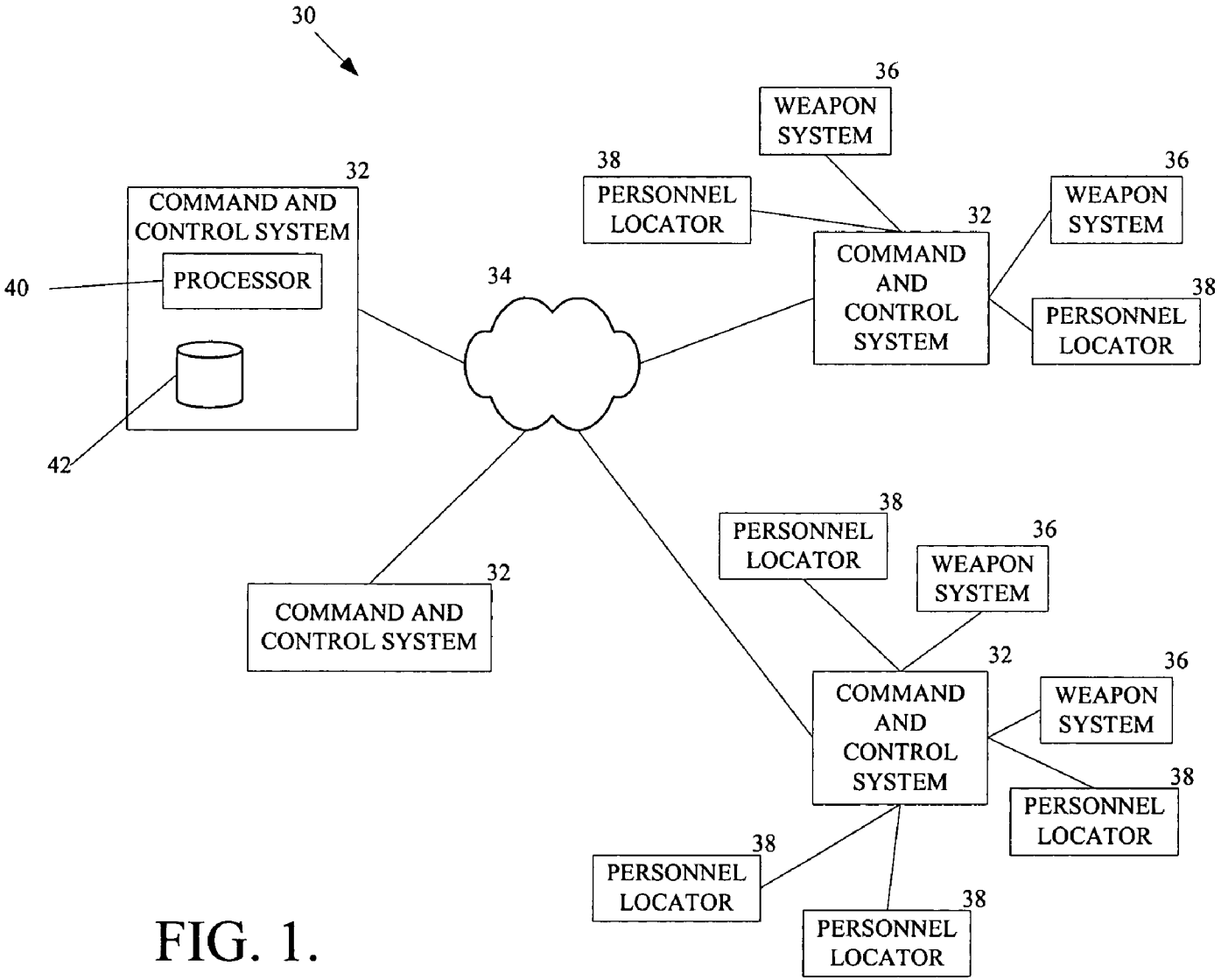
FIG. 1 illustrates a block diagram of an exemplary system formed in accordance with the present invention.

FIG. 1 illustrates a system 30 that prevents friendly fire instances from occurring. The system 30 includes a plurality of command and control systems 32 coupled to each other over a network 34. A plurality of weapon systems 36 and personnel locators 38 are in communication with a locally associated command and control system 32.

In one embodiment, the command and control systems 32 include computer systems having a processor 40 and a database 42. The database 42 stores at least a portion of an image of a battlefield where the system 30 is being employed. Each command and control system 32 receives location information of each of the personnel locators 38 and the command and control systems 32 that include personnel, such as aircraft and land and sea vehicles. The command and control systems 32 map the received location information onto the stored image of the battlefield or store location information relative to coordinates on the image. When any of the weapon systems 36 is placed into an aim mode, the command and control system 32 compares the area of effect of that weapon system 36 to the image of the battlefield. The command and control system 32 determines if any of the mapped location information is located within the area of effect of the weapon system 36. The command and control system 32 may then send out a disable signal or a warning signal to the weapon system 36 if such a case occurs. Thus, the command and control systems 32 determine if a weapon is being targeted at friendly military personnel, and may send a warning of the danger, or may even disable the weapon before it can be discharged.

An example of the type of image used is a battlefield imagery product, such as without limitation a Digital Point Positioning Database (DPPDB) image such as that produced by the National Imagery and Mapping Agency (NIMA). This type of image produces a latitude and longitude (Lat/Long) values for each pixel in the image, such as WGS-84. Satellites or other airborne vehicles previously produce these images. In one embodiment, each pixel is also given a height value that is determined by taking stereo pairs of images in order to generate the height value.

Figure 2:
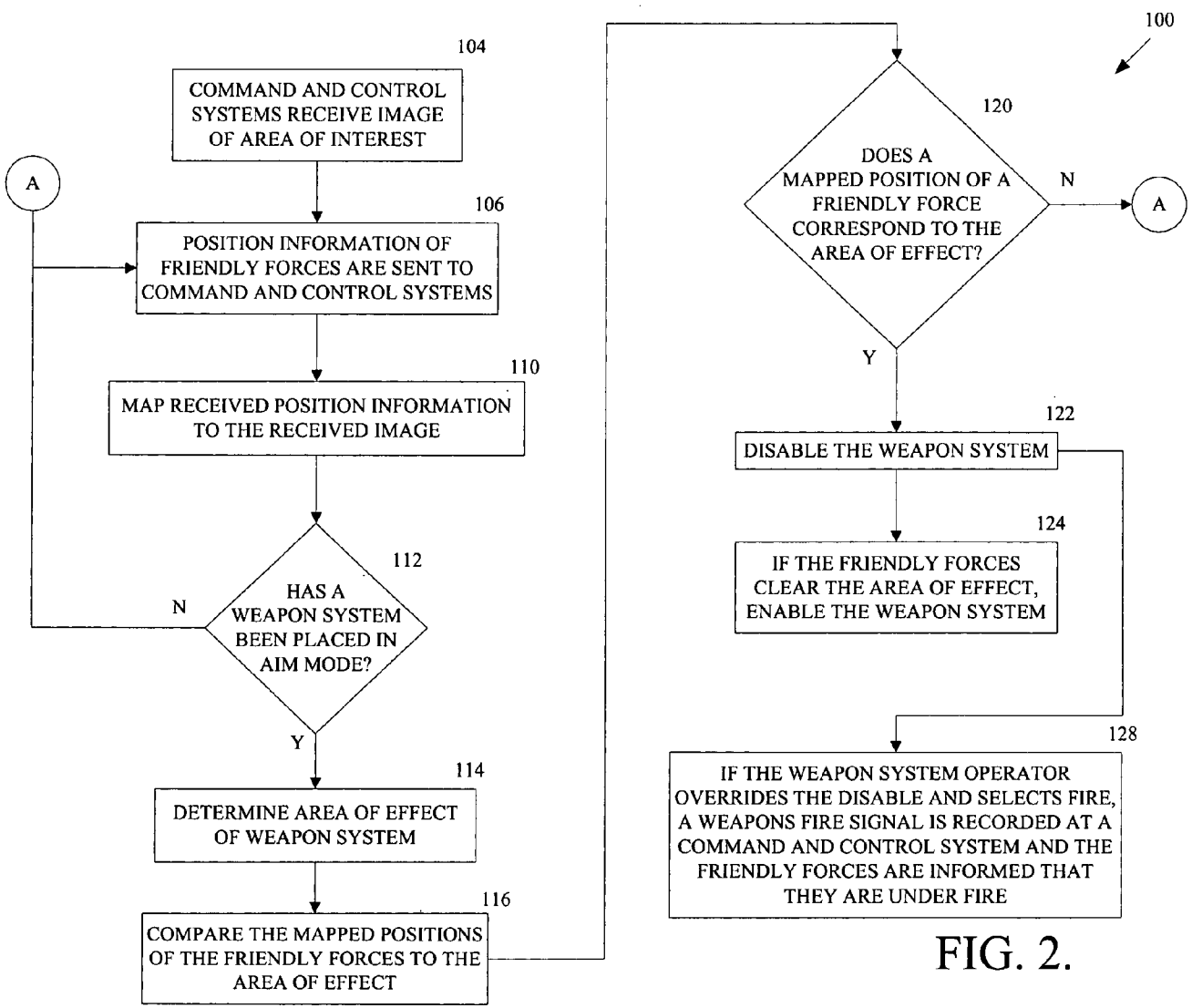
FIG. 2 illustrates a flow chart of an exemplary process performed by the system shown in FIG. 1.

FIG. 2 illustrates an exemplary process 100 performed by the system 30 shown in FIG. 1. At a block 104, each of the command and control systems 32 receive an image of an area of interest of a battlefield. The images of the areas of interest are preferably prestored into each of the command and control systems 32 prior to combat. The area of interest may be based on an effective range associated with each of the weapon systems 36 associated with the command and control system 32 and any internal weapon system of the command and control system 32. For example, if the weapon system associated with a command and control system 32 includes only short-range weapons (e.g. less than 1 mile) then the received image may suitably cover an area of approximately a 2-mile radius from the present location of the command and control system 32.

At a block 106, position information of friendly forces is generated by the personnel locators 38, the command and control systems 32, and the weapon systems 36 that may or may not include personnel. The generated position information is sent through local associated command and control systems 32 to other command and control systems 32 through the network 34. For example, a position locator device that is worn by a platoon soldier transmits position information to a local command and control system 32 that is located a quarter mile away in the vehicle of the platoon leader. At a block 110, each of the command and control systems 32 maps the received position information of the friendly forces to the received image.

At a decision block 112, the process 100 returns to the block 106 if no weapon system 36 has been placed in the aim mode. In one embodiment, the personnel locators 38 continuously determine position information and transmit the determined position information regardless of what the other components of the system 30 are doing. In one embodiment, the rate of transmitting position information is 1 Hz. Other rates of updating the position information may be used. In one embodiment, position information of a friendly system is transmitted to or transmitted by the command and control systems 32 if the friendly forces have performed a movement that is greater than a threshold amount. For example, a stationary battery of Patriot missiles will not need to continuously send position information through its associated command and control system through the network 34 to the other command and control systems 32. When the battery of patriot missiles is moved, position information of the patriot missile battery is sent to other command and control systems 32.

Once a weapon system 36 has been placed in the aim mode, at a block 114, the command and control system 32 associated with that weapon system 36 determines area of effect of that weapon system 36. The area of effect of a weapon system 36 is based on a number of factors related to the weapon system 36, such as type of munitions selected, location of weapon system 36, and line of sight of weapon system 36. This will be described by example in more detail below.

Next, at a block 116, the command and control system 32 associated with the weapon system 36 that is in the aim mode compares the area of effect of the weapon system 36 to the image that includes the mapped positions of friendly forces. If at a decision block 120 the command and control system 32 determines that no friendly forces correspond to the area of effect, then the process returns to the block 106 and repeats. If at the decision block 120, the command and control system 32 determines that one or more friendly systems do correspond to the area of effect, then in this embodiment the command and control system 32 sends a disable signal to the weapon system 36 that was placed in the aim mode, at a block 122. The weapon system 36 receives the disable signal and thus disables the weapon system 36.

At a block 124, the command and control system 32 associated with the disabled weapon system 36 continually determines if the area of effect of that weapon system 36 still correlates with mapped friendly force position information in the image. If the command and control system 32 determines that the friendly systems have cleared the area of effect, then the command and control system 32 sends an enable signal to the weapon system 36. Upon receiving the enable signal from the command and control system 32, the weapon system 36 is enabled for firing.

Alternately, at a block 128, if the operator of the weapon system 36 that was disabled overrides the disable and selects fire, a weapons fire signal is recorded at the command and control system 32. The command and control system 32 sends the recorded weapons fire signal to the friendly force(s) that is being targeted, thus informing them that they are under fire. The weapons fire signal may also be recorded by other higher-level command and control systems 32.

Figure 3:
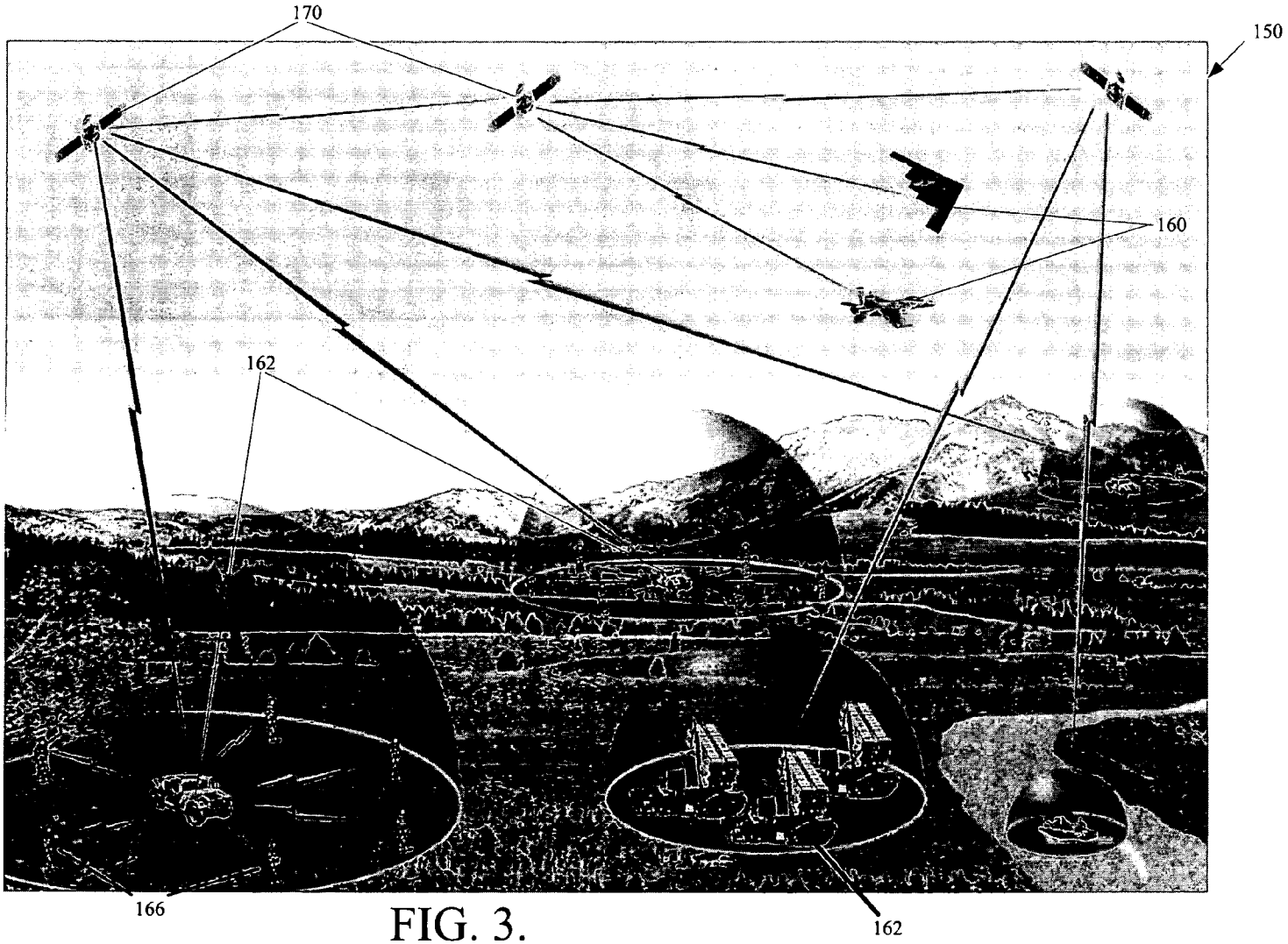
FIG. 3 illustrates an exemplary combat environment in which the system of FIG. 1 is employed.

FIG. 3 illustrates a simulated battlefield 150 that includes airborne command and control systems 160, a plurality of ground-based command and control facilities 162, and a plurality of personnel locators 166. In the battlefield 150 the airborne command and control systems 160 may also include weapon systems 36 and personnel locators 38. Also, many or all of the personnel 166 include both personnel locators 38 and weapon systems 36. The command and control systems 160 and 162 communicate over a satellite network 170. Each of the ground-based command and control systems 162 include satellite communication capabilities for linking up with the satellite network 170. For a ground-based command and control system 162, such as a Humvee, the weapon systems of the ground troops associated with the Humvee communicate via Low Probability of Intercept (LPI) short-range data links with the command and control system 162 in the Humvee. The personnel locator 38 worn by each troop may be a personal Global Positioning System (GPS) receiver or other positioning system. The position information of each troop is transmitted over the LPI data link to the Humvee. The Humvee then transmits the position information of each troop through the satellites 170 to the other airborne and ground-based command and control systems 160 and 162.

If for example an F/A-18 selects a weapon and places that weapon in the aim mode, the area of effect of that weapon is compared to the image that the F/A-18 stores and the mapped position information of all the friendly forces of the battlefield 150. If a mapped friendly force is identified as being within the area of effect of the selected weapon, then the processor within the F/A-18 may disable firing of the selected missile until the friendly force has cleared the area of effect or the F/A-18 pilot overrides and places the switch in the fire mode. Alternately, a warning signal may be given to the operator of the weapon, but the weapon may remain enabled for firing. If the F/A-18 operator overrides the disabled weapon system mode, a fire signal may be sent through the satellite network 170 to the targeted friendly force, thus informing them that they are under attack by a friendly weapon system.

Various types of data links are employed in the present invention. For example, satellite communication (SATCOM) links may be used to connect command and control systems with each other across a satellite network. Very low-power LPI radio frequency (RF) wireless links link personnel locators 38 to an associated weapon system 36. Low-power LPI RF wireless links link the weapon system 36 to the respective command and control system 32. The LPI links may use Ultra Wide Bandwidth (UWB) technology.

Each command and control system 32 includes and maintains a sufficiently-sized real-time geo-spatial intelligence database. The geo-spatial intelligence database includes high-resolution overhead battlefield reference imagery that supports precise Lat/Long position estimating for each pixel within the image. Lat/Long positioning of image pixels may be performed using World Geodetic System (WGS)-84 information. The geo-spatial database also includes digital terrain elevation data. The locations of friendly forces that report to the associated command and control system 32 are maintained within the geo-spatial database.

Figure 4:
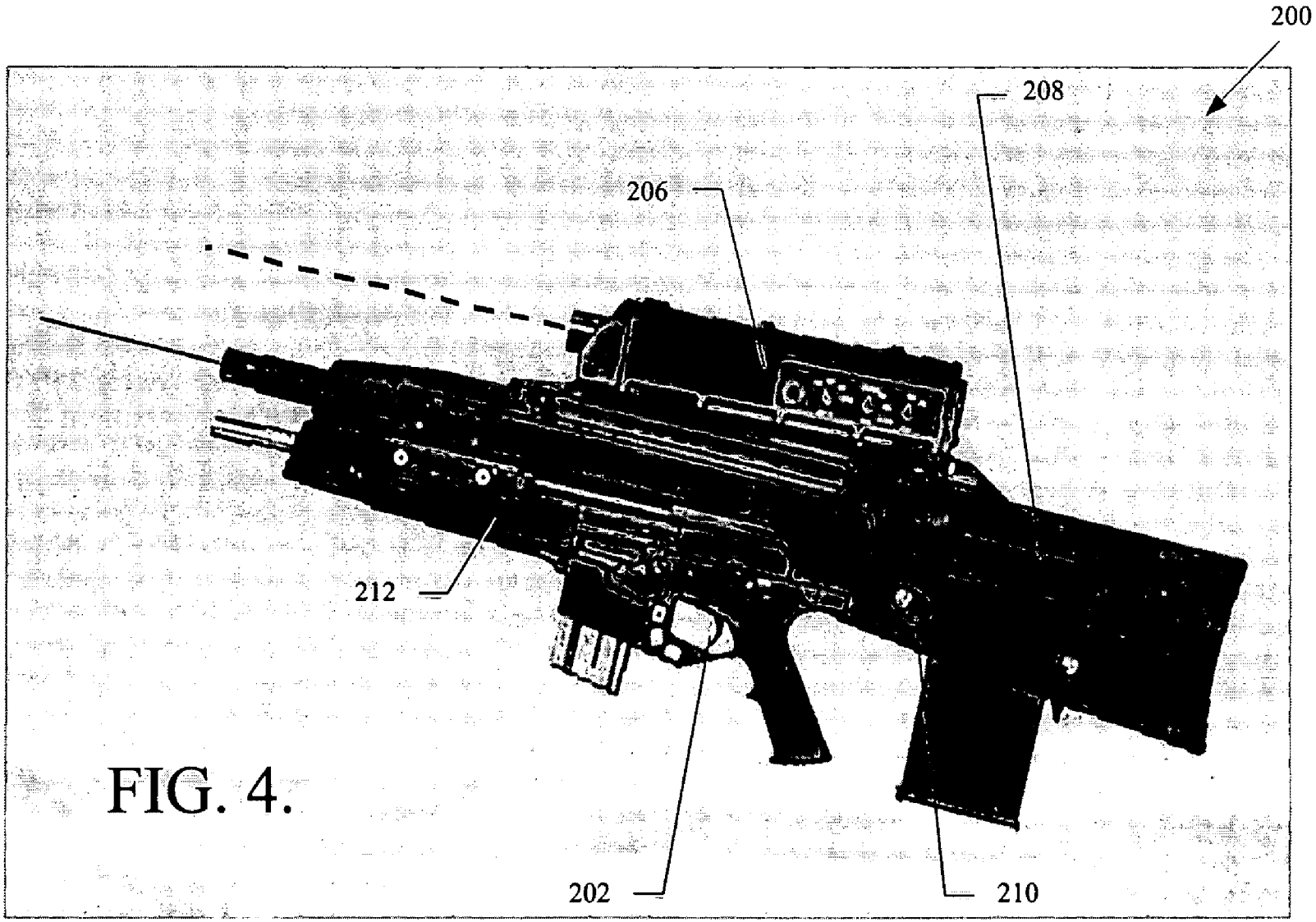
FIG. 4 illustrates an exemplary weapon system formed in accordance with the present invention.

FIG. 4 illustrates an example weapon system 200 for interacting with the system 30 shown in FIG. 1. The weapon system 200 includes a ranging device 206 that produces range information of whatever is being targeted. The ranging device 206 also includes a visual or audible alerting device that indicates, for example, when the weapon system 200 has been inhibited/disabled because the weapon system 200 is targeting a friendly force. The weapon system 200 also includes an inertial device 212, such as without limitation a miniature electromechanical system (MEMS) that determines the orientation of the weapon system 200 for determining targeting line of sight (LOS) information. The LOS information is sent to a communications component 208 that transmits the LOS information to the associated command and control system 32. The communications component 208 may be a low-powered UWB RF communication device.

The weapon system 200 includes a weapon mode control switch 210 that places the weapon in one of an off, ready, or override mode. Also, the weapon system 200 includes a two detent electromechanical trigger 202. One detent places the weapon system 200 in the aim mode and a second detent places the weapon system 200 in the fire mode. Movement of the trigger 202 from the first detent to the second detent may be inhibited if the command and control system 32 determined that the field of effect of the weapon system 200 was colocated with a friendly force.

It will be appreciated that disabling of a weapon or alerting the targeted/effect entity may occur when a weapon system is in aim mode or fire mode.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

What is claimed is:

1. A system comprising:

a plurality of locator devices each having a communication component and each being adapted to determine location information of one or more friendly personnel;

a plurality of weapon systems having a communication component, the weapon systems being adapted to determine weapon effect information and determine if the weapon is in an aim mode or fire mode;

a plurality of computer-based systems each including:

a first communication component adapted to receive the determined location information, the determined weapon effect information, and the weapon mode;

memory adapted to store received location information;

a second communication component adapted to communicate with other computer-based systems; and a processor adapted to determine if at least one of the friendly personnel is effected by one of the weapon systems based on the received location information, and the weapon effect information and generating a responsive signal, if at least one of the friendly personnel is determined to be effected by one of the weapon systems and the weapon is determined to be in the fire mode.

2. The system of claim 1, wherein the responsive signal includes a disable signal adapted to disable operation of a corresponding one of the weapon systems.

3. The system of claim 1 wherein the weapon effect information is based on selected munitions information.

4. The system of claim 1, wherein the responsive signal includes a warning signal adapted to alert an operator of a corresponding one of the weapon systems.

5. The system of claim 1, wherein one or more of the weapon systems include a device adapted to put the weapon system in a disable state, if the communication component of the weapon system receives a disable signal from the first communication component.

6. The system of claim 5, wherein one or more of the weapon systems include an override switch adapted to allow an operator to override the disabled state of the weapon system and put the weapon system in the fire mode, and a component adapted to generate an alert signal when the override switch has been activated and send the alert signal to the associated computer-based system.

7. The system of claim 6, further comprising:

a plurality of output devices associated with one or more of the friendly personnel, wherein the computer-based system that receives an alert signal is adapted to transmit the received alert signal to at least one of the output device associated with the friendly personnel determined to be effected by one of the weapon systems or the computer-based system associated with the personnel determined to be effected by one of the weapon systems, wherein when the alert signal is transmitted to the computer-based system associated with the personnel determined to be effected by one of the weapon systems, the associated computer-based system transmits the alert signal to the output device associated with the friendly personnel determined to be effected by one of the weapon systems, wherein the output device is adapted to output an alert based on the received alert signal.

8. The system of claim 1, wherein the second communication component communicates over a wireless network.

9. The system of claim 8, wherein the wireless network includes a satellite network.

10. The system of claim 1, wherein the first communication component communicates wirelessly with associated locator devices and weapon systems.

11. The system of claim 1, wherein at least one of the locator devices include a global positioning receiver.

12. The system of claim 1, wherein the memory further includes an image of a battlefield, and wherein the processor determines if one or more friendly personnel would be effected by one of the weapon systems by mapping location information to the image, determines an area of effect on the image based on the weapon effect information, and determines if the location information places one or more friendly personnel within the area of effect on the image.

13. The system of claim 1, wherein one or more of the locator devices sends the generated location information if the locator device has moved greater than a threshold amount when compared to previous location information.

14. A system comprising:

a first communication component adapted to receive the location information of one or more friendly personnel and the weapon effect information of one or more friendly weapon systems;

memory adapted to store the received location information;

a second communication component adapted to communicate with other systems; and a processor adapted to determine if one or more friendly personnel are effected by one of the weapon systems based on the stored location information, and the weapon effect information, and adapted to generate a responsive signal, if a friendly personnel is determined to be effected by one of the weapon systems and the weapon is determined to be in the fire mode.

15. The system of claim 14, wherein the responsive signal includes a disable signal adapted to disable operation of a corresponding one of the weapon systems.

16. The system of claim 14, wherein the responsive signal includes a warning signal adapted to alert an operator of a corresponding one of the weapon systems.

17. The system of claim 14, wherein when the system receives an alert signal the system transmits the received alert signal to at least one of a device associated with the friendly personnel determined to be effected by one of the weapon systems or the system associated with the personnel determined to be effected by one of the weapon systems.

18. The system of claim 14, wherein the second communication component communicates over a wireless network.

19. The system of claim 18, wherein the wireless network includes a satellite network.

20. The system of claim 14, wherein the first communication component communicates wirelessly with associated locator devices and weapon systems.

21. The system of claim 14, wherein the memory is adapted to store an image of a battlefield, and wherein the processor determines if one or more friendly personnel would be effected by one of the weapon systems by associating location information with the image, determines an area of effect on the image based on the weapon effect information, and determines if the location information places one or more friendly personnel within the area of effect on the image.

* * * * *